US005884773A

United States Patent [19]

Rudi

[11] Patent Number: 5,884,773

[45] Date of Patent: Mar. 23, 1999

[54] CARRIER STRIP AND METHOD OF ITS MANUFACTURING

[75] Inventor: Kolb Rudi, Füssen-Hopfen, Germany

[73] Assignee: Unimet GmbH, Rieden, Germany

[21] Appl. No.: 45,443

[22] Filed: Mar. 20, 1998

[30] Foreign Application Priority Data

Mar. 21, 1997 [DE] Germany ..... 197 11 746.5

[51] Int. Cl.[6] ..... B65D 85/00; B65D 73/02

[52] U.S. Cl. ..... 206/713; 206/477; 206/482

[58] Field of Search ..... 206/701, 711, 206/713, 477, 482, 328, 330

[56] References Cited

U.S. PATENT DOCUMENTS

| | | | |
|---|---|---|---|
| 3,841,472 | 10/1974 | Fuller et al. | 206/713 |
| 4,411,361 | 10/1983 | Mentzer | 206/477 |
| 4,799,589 | 1/1989 | Peleckis | 206/330 |
| 4,871,062 | 10/1989 | Gordon, Jr. | 206/328 |
| 5,706,952 | 1/1998 | Bianca et al. | 206/713 |

*Primary Examiner*—Paul T. Sewell
*Assistant Examiner*—J. Mohandesi
*Attorney, Agent, or Firm*—Notaro & Michalos P.C.

[57] ABSTRACT

A sheet metal carrier strip for electrical pins used for the production of electrical multipole connectors, comprises a planar substantially rectangular base portion 24. Two rows of upright legs 26, 30 are formed at each longitudinal edge of the base portion 24. The legs 26, 30 are alternately arranged in parallel vertical planes transversely offset one from another by at least the thickness of the legs 26, 30. A recess 14, 16 is provided in each leg, the recess opening at the upper edge of the leg 26, 30. All recesses 14, 16 in pairs are transversely aligned and designed to insert a contact pin 34 respectively. An interspace formed between each pair of adjacent legs 26, 26 of each row of legs is smaller then the width of the legs 28 of the adjacent row of legs as measured in longitudinal direction of the carrier strip 10, so that a leg 26 of one row is overlapped by a pair of legs 28 of the adjacent row respectively as seen in transverse direction.

3 Claims, 2 Drawing Sheets

CARRIER STRIP AND METHOD OF ITS MANUFACTURING

BACKGROUND OF THE INVENTION

This invention relates to a sheet metal carrier strip for electrical contact pins used for the production of electrical multipole connectors, comprising a planar substantially rectangular base portion, two rows of upright legs formed at each longitudinal edge of the base portion, the legs of both rows alternately arranged in parallel vertical planes transversely offset one from another by at least the thickness of the legs, a recess provided in each leg, the recess opening at an upper edge of the leg, all recesses in pairs being transversely aligned and designed to insert a contact pin respectively.

A carrier strip of this kind is known from DE-U-9314510. This carrier strip comprises legs, which are separated via transverse separating cuts in the strip, and afterwards bent upright. According to this document the legs follow each other without spacing. Based on a center-to-center spacing of the contact pins of 0.050 inches the arms of each leg, which are holding the contact pins, have a width of approx. 0.012 inches. The thickness of the legs is about the same. Thus the upright arms of the legs have a very small diameter with respective bending tenderness. Consequently the insertion of the contact pins requires a high-grade accuracy for both strength effort and direction. Even minimum misalignments might lead to a distortion of the legs'arms.

The EP-A-0501392 discloses a carrier strip similiar to the aforementioned, where the distance between the upright bent legs is not alternating but staying the same. Instead of the alternating distance of each pair of legs is transversely offset by at least one thickness of the legs. The separation of the legs is effected via shearing at predetermined lines. As a result the edges of the consecutive legs are transversely offset, but positioned at the same transverse planes defined by the respective cut lines.

The DE-C-4014557 discloses a carrier strip with free cuts between each two legs. Then the legs are bent upward, so that they form edges of the strip in the same longitudinal planes.

OBJECTS AND BRIEF SUMMARY OF THE INVENTION

Main object of the invention is to provide a carrier strip and a method for it's production, which comprises an additional stabilization for the upward bent legs.

A further object of the invention is to provide a carrier strip for electrical contact pins used for the production of electrical multipole connectors, comprising a planar substantially rectangular base portion, two rows of upright legs firmed at each longitudinal edge of the base portion, the legs of both rows alternately arranged in parallel vertical planes transversely offset one from another by at least the thickness of the legs, a recess provided in each leg, the recess opening at an upper edge of the leg, all recesses in pairs being transversely aligned and designed to insert a contact pin respectively, an interspace formed between each pair of adjacent legs of each row of legs being smaller then the width of the legs of the adjacent row of legs as measured in longitudinal direction of the carrier strip, so that a leg of one row is overlapped by a pair of legs of the adjacent row respectively as seen in transverse direction.

It is still a further object of the invention to provide a carrier strip in which all legs on each side of the strip are in mutual contact with one another.

It is the advantage of the invention that according to the overlapping of the neighbored arms of the legs there is a mutual support engagement and thus the resistance of distortion of a pair of overlapping arms of the legs is increased. This results in an overall higher stability of the carrier strip. This advantage is reached without additional efforts due to the fact, that according to claim 3 the separation of the legs as well as their bending about the inner fold lines is done in one shearingbending action, which also results in a lengthening of the legs. Based on a center-to-center spacing of the contact pins of 0.050 inches and a thickness of the contact pins of 0.024 inches the arms of the legs have a width of about 0.012 inches. Due to the inventionary shearing-bending action with a tool with respective punch and die geometry the material is distorted in the shearing area in the sense of a broadening of the legs in comparison to the cut line spacing. By this means the result is the mutual overlap and support of the legs.

Last but not least it is a further object of the invention to provide a method for manufacturing a carrier strip, wherein both side contours of the strip are punched to form a series of recesses at each side of the strips whereafter a series of legs is formed at each side of the strip by a cutting between each pair of recesses and the legs are bent upwardly around staggered inner and outer fold lines on each side of the base portion of the strip, which fold lines being transversely offset one from another by an amount that bottom edges of all recesses are on the same level above the base portion, and wherein cutting of the strip and bending of the legs around the inner fold lines is performed by a common shearing-bending action in which the legs are broadened in longitudinal direction and after having bent upwardly the remaining legs around both outer folding lines, each leg bent around one fold line overlaps a pair of adjacent legs bent around the other fold line on each side of the strip.

Other objects and advantages of the invention will become apparent from the subsequent detailed description of a preferred embodiment, in connection with the drawings.

DETAILED DESCRIPTION OF A PREFERRED EMBODIMENT

Figure 2:
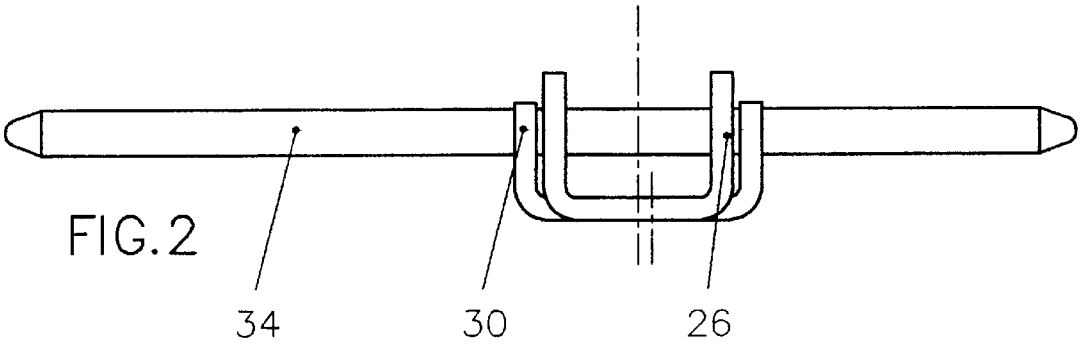
FIG. 2 shows a front view of a carrier strip on a larger scale.
Figure 1:
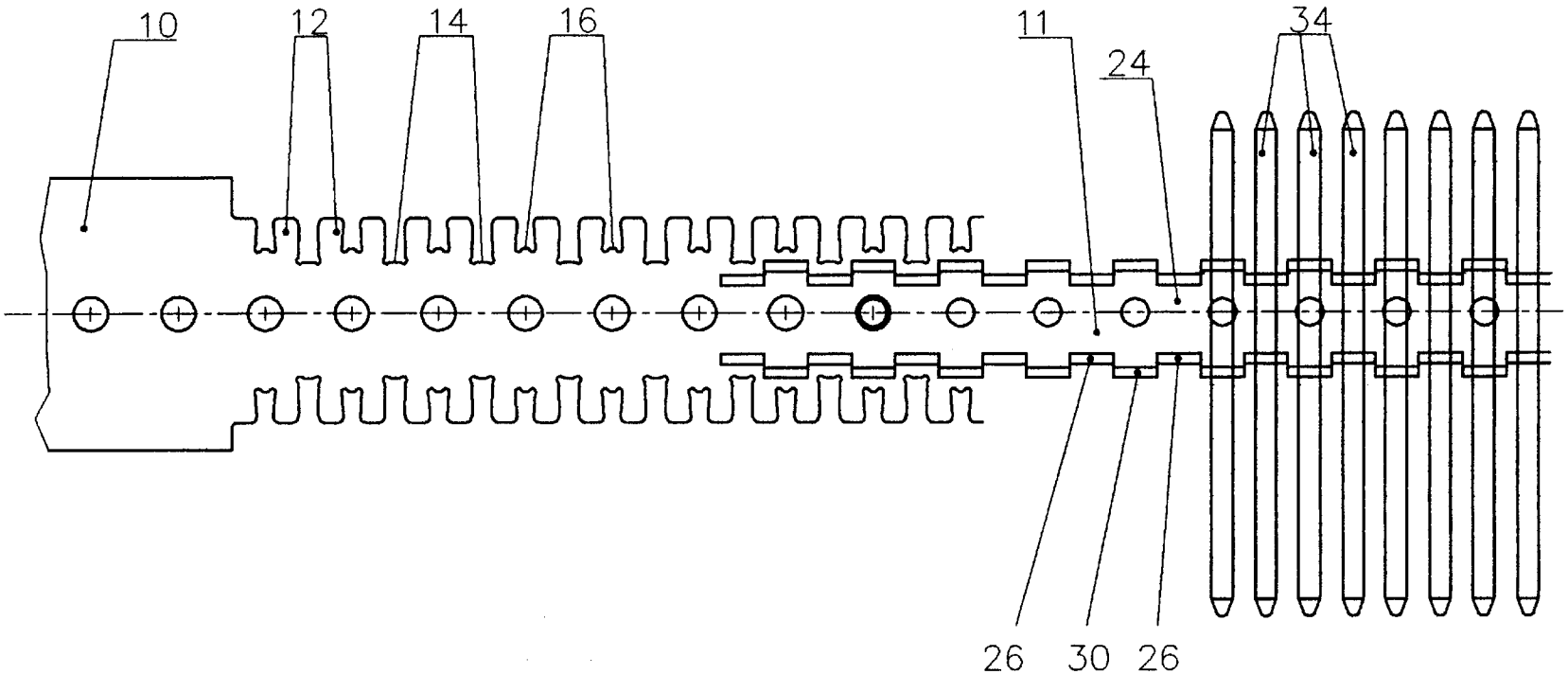
FIG. 1 shows a plan view of a band, which is—in several method steps—shaped to form a carrier strip, into which contact pins are inserted.

A rough band 10 is punched into contours at both sides, whereas sections 12 arise, which show recesses 14 and 16 between each section. Here recesses 14 with a larger depth alternate with recesses 16 with a smaller depth. In a consecutive bending area the sections 12 first are separated in two arms 18, 20 and 18', 20'. This separating step is a shearing-bending action, during which the longer arms 18 at each side of the recess 14 are bent from a base portion 24 of the carrier strip 11 around a fold line 22. The bending action takes place around a die with a radius $R_{inner}$. The punch has a radius $R_{outer}$, which is smaller than $R_{inner}$ plus the thickness of the arms 18, 20. This results in an additional material distortion. Due to this shearing-bending action the width of the resulting leg 26 is larger than the spacing of the cut lines 28 of the not yet bent legs 30. The broadening is largest in the bending area. When the first row of legs 26 has been shear-bent around the fold line 22, in the next method step the legs 30 of the base portion 14 having the smaller recesses 16 are bent upwardly around a second fold line 23, which is transversely offset outwards from the first fold line 22 by at least the thickness of the material of the legs 26, 30. The legs 30 of each longitudinal edge of the carrier strip 24 lie in an outer plane in a 90° angle to the base portion 24 and the first bent legs 26 are within a second plane inwardly offset, which also forms a 90° angle with the base portion. Due to the broading of the legs 26 as well as—at least in the bending area—the legs 30 in longitudinal direction, all legs 26, 30 mutually overlap and in contact one another and thereby in mutual support engagement. Interspaces 36 formed between the legs 26 of the inner row of legs therefor are smaller than the width of the legs 30 of the outer rows and the interspaces 38 between the legs 30 of the outer rows are smaller than the width of the legs 26 of the inner rows.

Figure 4:
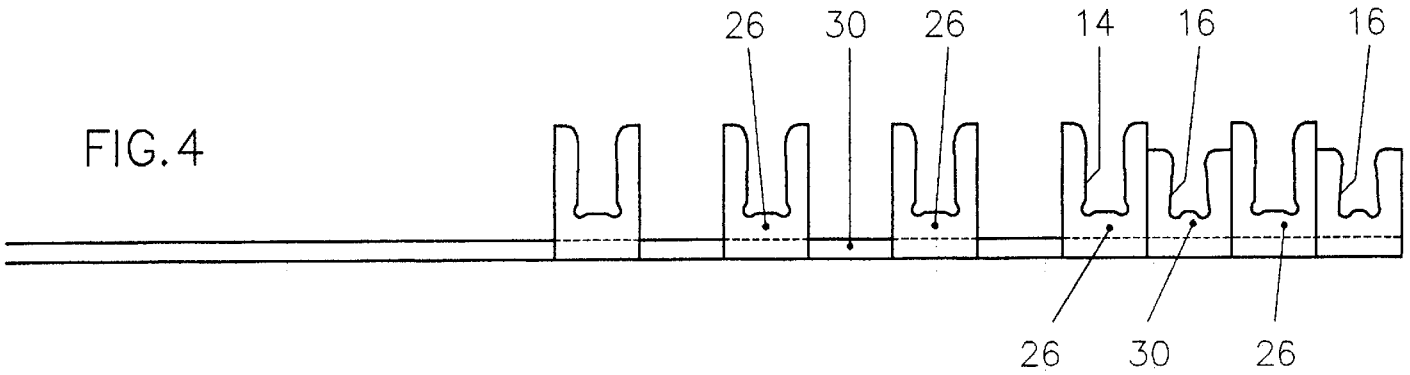
FIG. 4 shows a side view of the bending area of a carrier strip.
Figure 3:
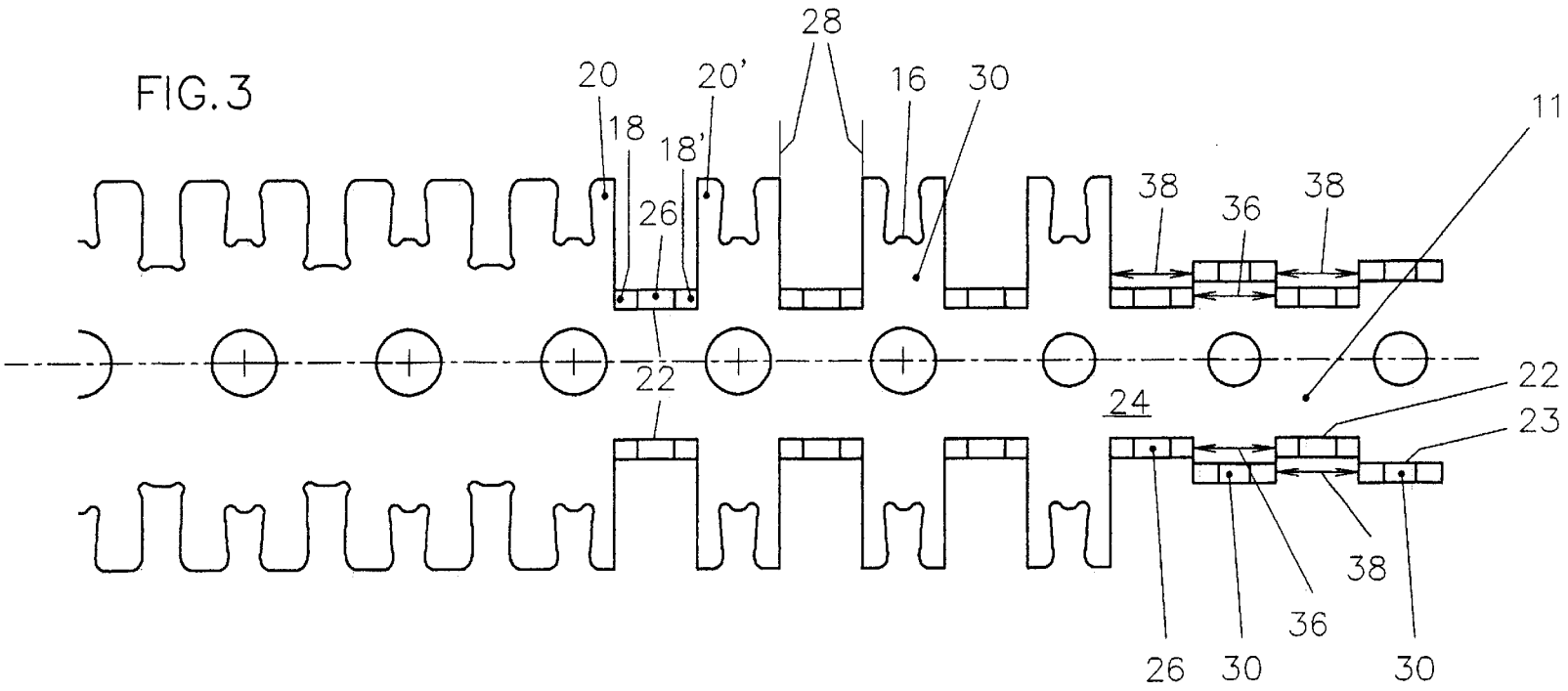
FIG. 3 shows a plan view of the bending area of a carrier strip on a larger scale.

As can be seen from FIG. 4, the inner legs 26 are higher than the out legs 30, however, the bottom edges of the recesses 14 and 16 are on the same level. This is caused by the staggered arrangement of the fold lines 22 and 23 The respective distance between the fold lines 22, 23 and the bottom edges of the recesses 14, 16 is always the same. The bending area is neighbored by an inserting area, where contact pins 34 are inserted into the transversely aligned recesses 14, 14 of the inner legs 26 as well as the recesses 16, 16 of the outer legs 30.

I claim:

1. A sheet metal carrier strip for electrical contact pins used for the production of electrical multipole connectors, comprising a planar substantially rectangular base portion, two rows of upright legs formed at each longitudinal edge of the base portion, the legs of both rows alternately arranged in parallel vertical planes transversely offset one from another by at least the thickness of the legs, a recess provided in each leg, the recess opening at an upper edge of the leg, all recesses in pairs being transversely aligned and designed to resume a contact pin, an interspace formed between each pair of adjacent legs of each row of legs being smaller then the width of the legs of the adjacent row of legs as measured in a longitudinal direction of the carrier strip, so that a leg of one row is overlapped by a pair of legs of the adjacent row respectively as seen in a transverse direction.

2. A carrier strip as claimed in claim 1, wherein all legs on each side of the strip are in mutual contact with one another.

3. Method for manufacturing of a carrier strip as claimed in claim 1, wherein both side contours of the strip are punched to form a series of recesses at each side of the strips whereafter a series of legs is formed at each side of the strip by a cutting between each pair of recesses and the legs are bent upwardly around staggered inner and outer fold lines on each side of the base portion of the strip, which fold lines being transversely offset one from another by an amount that bottom edges of all recesses are on the same level above the base portion, and wherein cutting of the strip and bending of the legs around the inner fold lines is performed by a shearing-bending action in which the legs are broadened in the longitudinal direction and after having bent upwardly the remaining legs around both outer folding lines, each leg bent around one fold line overlaps a pair of adjacent legs bent around the other fold line on each side of the strip.

* * * * *